US006761670B2

(12) United States Patent
Liou

(10) Patent No.: US 6,761,670 B2
(45) Date of Patent: Jul. 13, 2004

(54) EXERCISER HAVING AN IMPROVED RESISTIVE DEVICE

(76) Inventor: Jiann Bang Liou, No. 12, Avenue 37, Lane 122, Der Long Road, Taiping City, Taichung (TW), 411

( * ) Notice: Subject to any disclaimer, the term of this patent is extended or adjusted under 35 U.S.C. 154(b) by 283 days.

(21) Appl. No.: 10/043,845

(22) Filed: Jan. 14, 2002

(65) Prior Publication Data

US 2003/0134719 A1 Jul. 17, 2003

(51) Int. Cl.[7] ..... A63B 69/06; A63B 69/16
(52) U.S. Cl. ..... 482/72; 482/57
(58) Field of Search ..... 482/72, 56–57, 482/127, 52, 900

(56) References Cited

U.S. PATENT DOCUMENTS 2,512,911 A * 6/1950 Benice ..... 482/72
4,674,741 A * 6/1987 Pasierb et al. ..... 482/72
5,013,033 A * 5/1991 Watterson et al. ..... 482/72
5,916,069 A * 6/1999 Wang et al. ..... 482/72
6,090,017 A * 7/2000 Wang ..... 482/72
6,488,611 B1 * 12/2002 Ambrosina et al. ..... 482/63
6,641,507 B1 * 11/2003 Warner et al. ..... 482/63

FOREIGN PATENT DOCUMENTS

GB 2175813 A * 12/1986 ..... A63B/21/02

* cited by examiner

*Primary Examiner*—Nicholas D. Lucchesi
*Assistant Examiner*—Fenn C Mathew

(57) ABSTRACT

An exerciser includes a wheel and a housing rotatably engaged on a shaft, a unidirectional bearing disposed between the wheel and the housing for allowing the wheel to be rotated in an active direction by the housing and to be prevented from rotating in a reverse direction by the housing. A strap may be used to rotate the housing in the active direction. A spring may bias the housing to rotate in the reverse direction, and will not bias the wheel when the spring biases the housing to rotate backward in the reverse direction, such that the spring will not be damaged by the wheel.

13 Claims, 7 Drawing Sheets

EXERCISER HAVING AN IMPROVED RESISTIVE DEVICE

BACKGROUND OF THE INVENTION

1. Field of the Invention

The present invention relates to an exerciser, and more particularly to an exerciser having an improved resistive device or mechanism.

2. Description of the Prior Art

Various kinds of typical exercisers, such as the rowing type exercisers, the cycle exercisers, the pulling type exercisers, etc., have been developed for allowing the users to conduct exercises at home. FIGS. 1 and 2 show one of the typical rowing type exercisers which comprises a seat 10 slidably engaged and supported on a track 11 or the like, and a pair of foot pedals 12 for being stepped by the users. A resistive device includes a paddle wheel, or a weight or another wheel 90 rotatably secured on a base 17 which is provided or disposed on the front portion of the track 11, a housing 91 secured to the wheel 90, and a spring member 92 secured to the housing 91 for further providing a resistive force or a spring biasing force against the housing 91 and the wheel 90. A handle 13 is coupled to the wheel 90 and/or the housing 91 with a coil of thread or cable or strap 14, for pulling and thus rotating the wheel 90, such that the wheel 90 and the housing 91 and the spring member 92 may apply a resistive force against the handle 13. When the handle 13 is released, the spring member 92 may bias the housing 91 and thus the wheel 90 backward to the original position. The housing 91 and thus the spring member 92 are solidly secured to the wheel 90, such that the spring member 92 may bias the wheel 90 and the housing 91 whenever the wheel 90 and the housing 91 are rotated in an active direction and in the reverse direction. The spring member 92 may even be over-loaded when the wheel 90 and the housing 91 have been biased by the spring member 92 and over rotated in the reverse direction. The spring member 92 may thus be quickly damaged.

As shown in FIG. 3, illustrated is another typical exerciser similar to that shown in FIG. 1 and also comprising a seat 10 slidably engaged on a track 11, a pair of foot pedals 12 for being stepped by the users, a wheel 90 and a housing 91 rotatably secured on a base 17, and a spring member 92 secured to the housing 91 for providing a resistive force or a spring biasing force against the housing 91 and the wheel 90. A handle 13 is also coupled to the wheel 90 and/or the housing 91 with a coil of thread or cable or strap 14, for pulling and thus rotating and actuating the wheel 90, such that the wheel 90 and the housing 91 and the spring member 92 may apply a resistive force against the handle 13. A number of coupling members and elements are further required and provided for coupling the wheel 90 and the housing 91 and thus the spring member 92 together.

As shown in FIG. 4, illustrated is a further typical exerciser similar to that shown in FIGS. 1 and 3 and also comprising a seat 10 slidably engaged on a track 11, a pair of foot pedals 12 for being stepped by the users, a wheel 90 and a housing 91 rotatably secured on a base 17, and a spring member 92 secured to the housing 91 for providing a resistive force or a spring biasing force against the housing 91 and the wheel 90. Two handles 13 are coupled to the wheel 90 and/or the housing 91 with two coils of threads or straps 14, for actuating the wheel 90. A magnetic resistive device 93 is further provided for providing a resistive force against the housing 91 and the wheel 90. However, the spring member 92 may also have a good chance to be over-loaded when the wheel 90 and the housing 91 have been biased by the spring member 92 and over rotated in the reverse direction. The spring member 92 may also be quickly damaged.

As shown in FIG. 5, illustrated is a still further typical exerciser similar to that shown in FIGS. 1–4 and also comprising a wheel 90 and a housing 91 separately and rotatably secured on a base 17, and a spring member 92 secured to the housing 91 for providing a resistive force or a spring biasing force against the housing 91 and the wheel 90. A handle 13 is coupled to the wheel 90 and/or the housing 91 with a strap 14, for actuating the wheel 90. Similarly, a number of coupling members and elements are further required and provided for coupling the wheel 90 and the housing 91 and thus the spring member 92 together. The resistive device may include a huge volume that is adverse for storing and transportation purposes.

The present invention has arisen to mitigate and/or obviate the afore-described disadvantages of the conventional exercisers.

SUMMARY OF THE INVENTION

The primary objective of the present invention is to provide an exerciser including an improved resistive device or mechanism for preventing the spring biasing member from being over-loaded and for increasing the working life of the spring biasing member.

In accordance with one aspect of the invention, there is provided a resistive device for an exerciser comprising a shaft, a wheel rotatably engaged on the shaft, a housing rotatably engaged on the shaft, a unidirectional bearing provided between the wheel and the housing, for allowing the wheel to be rotated in an active direction by the housing, and for preventing the wheel to be rotated in a reverse direction by the housing, means for rotating the housing relative to the shaft to rotate the wheel in the active direction, and spring biasing means for biasing the housing to rotate in the reverse direction relative to the shaft. The wheel may be prevented from rotated in the reverse direction by the housing when the housing is biased backward in the reverse direction by the spring biasing means, such that the spring biasing means will not apply a spring biasing force against the wheel when the spring biasing means biases the housing to rotate backward in the reverse direction, such that the spring biasing means may be prevented from being over loaded or over actuated or damaged by the wheel and such that the working life of the spring biasing means may be increased.

A conduit is further provided and rotatably engaged on the shaft, the housing is secured to the conduit and rotated in concert with the conduit, and the unidirectional bearing is provided between the wheel and the conduit for allowing the conduit and thus the wheel to be rotated in the active direction by the housing.

The wheel includes a bracket provided thereon, the conduit includes a bucket extended therefrom and engaged in the bracket of the wheel, the unidirectional bearing is engaged between the bracket of the wheel and the bucket of the conduit.

The housing includes a duct extended therefrom and engaged on and secured to the conduit. The rotating means includes a strap engaged on the duct of the housing, the strap includes a first end secured to the duct and a second end for being pulled to rotate the housing relative to the shaft.

A panel is further provided and engaged with the strap for retaining the strap between the panel and the housing.

The biasing means includes a spring member provided between the shaft and the housing for biasing the housing to rotate in the reverse direction relative to the shaft.

The housing includes a chamber formed therein for receiving the spring member, the spring member includes a first end secured to the housing. The housing includes a groove formed therein, the first end of the spring member is hooked to the groove of the housing.

A spacer is further provided and secured on the shaft, the spring member includes a first end secured to the spacer. The spacer includes a slot formed therein, the first end of the spring member is hooked to the slot of the spacer.

Two plates are further provided and secured on the shaft and engaged with the spacer, the spring member is engaged on the spacer. The spacer includes two ends secured to the plates respectively.

The plates each includes a non-circular recess formed therein, the ends of the spacer each includes a non-circular cross section and engaged in the non-circular recesses of the plates respectively for securing the spacer between the plates.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
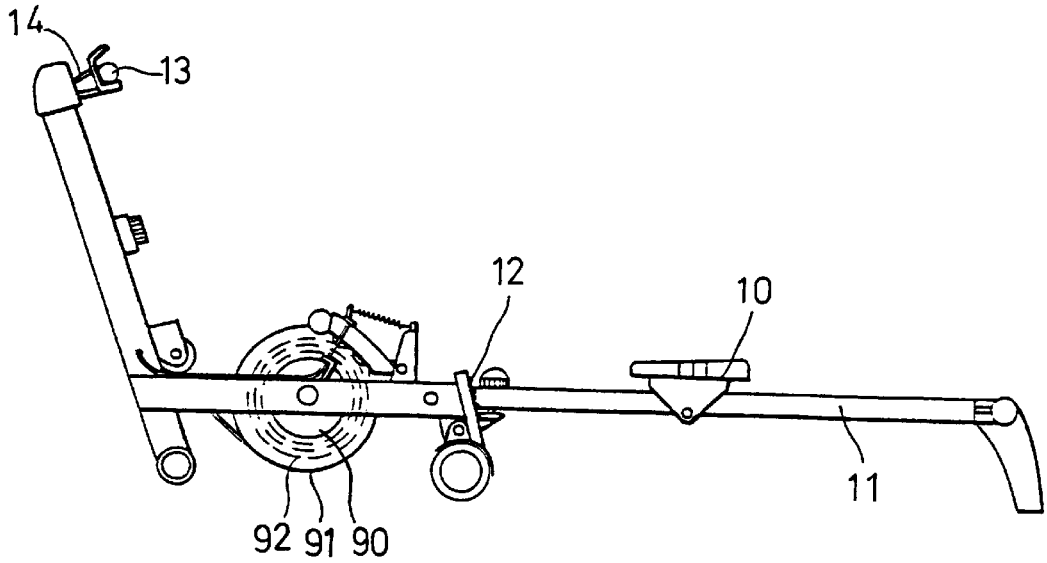
FIG. 1 PRIOR ART
FIG. 1 is a plan view illustrating a typical rowing type exerciser.
Figure 2:
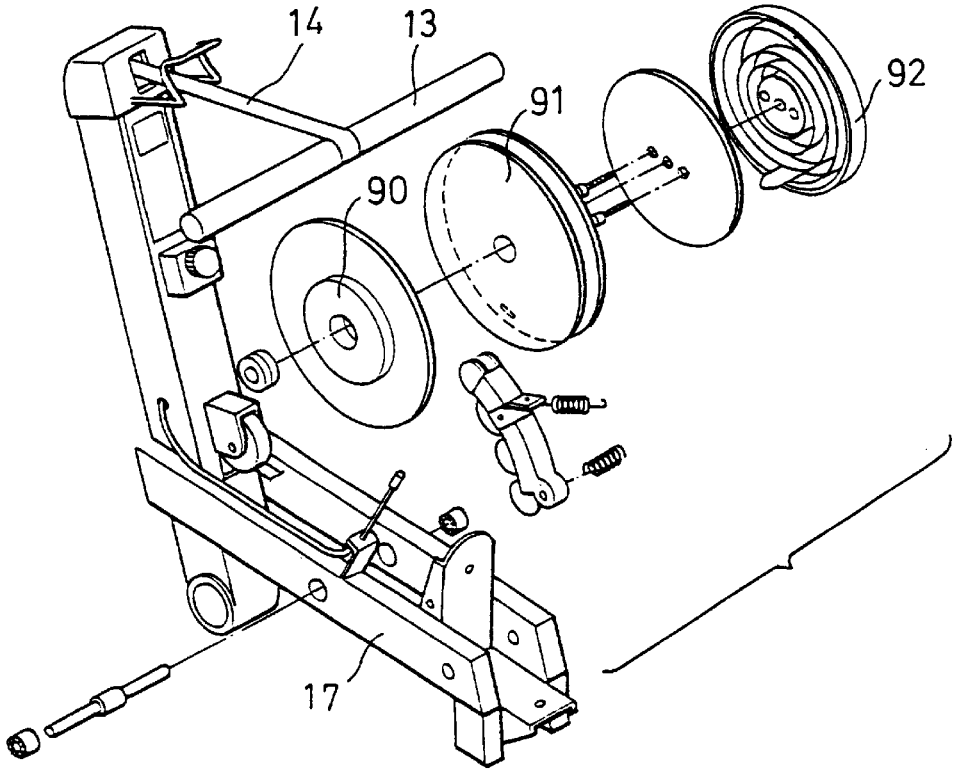
FIG. 2 PRIOR ART
FIG. 2 is a partial exploded view illustrating a resistive device for the exerciser as shown in FIG. 1.
Figure 3:
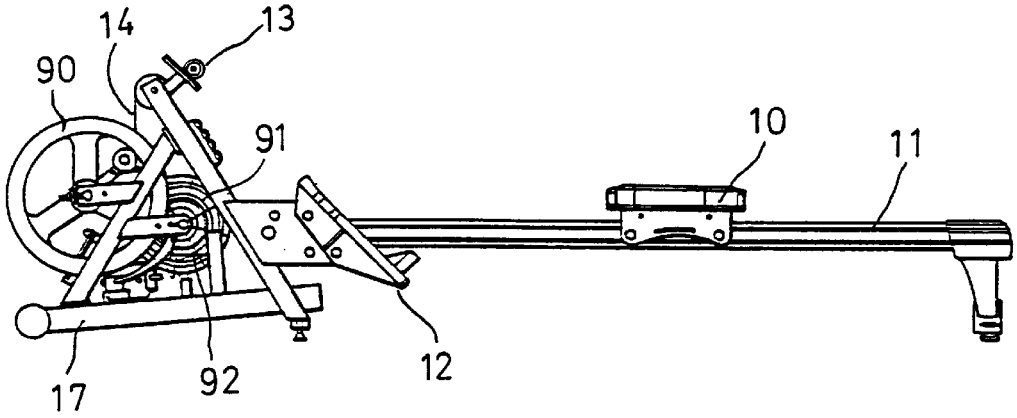
FIG. 3 PRIOR ART
FIG. 3 is a plan view similar to FIG. 1, illustrating another typical rowing type exerciser.
Figure 4:
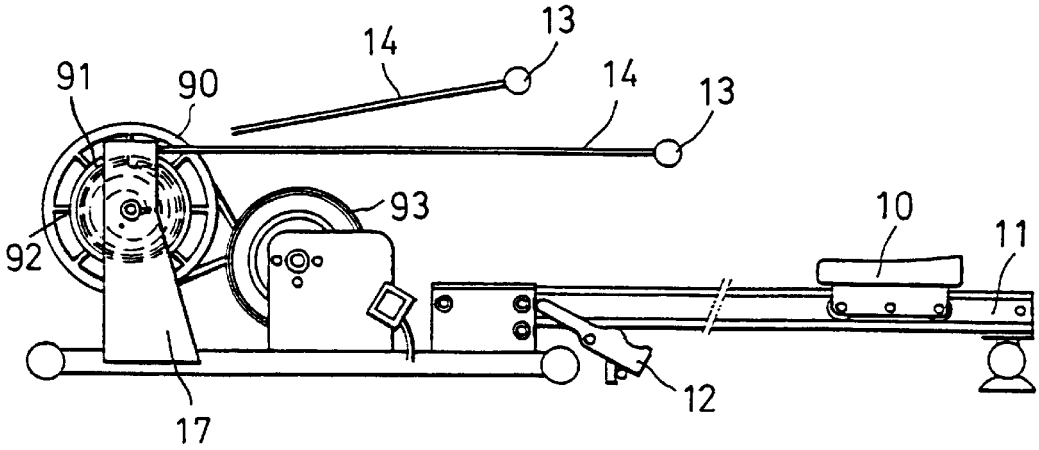
FIG. 4 PRIOR ART
FIG. 4 is a plan view similar to FIGS. 1 and 3, illustrating a further typical rowing type exerciser.
Figure 5:
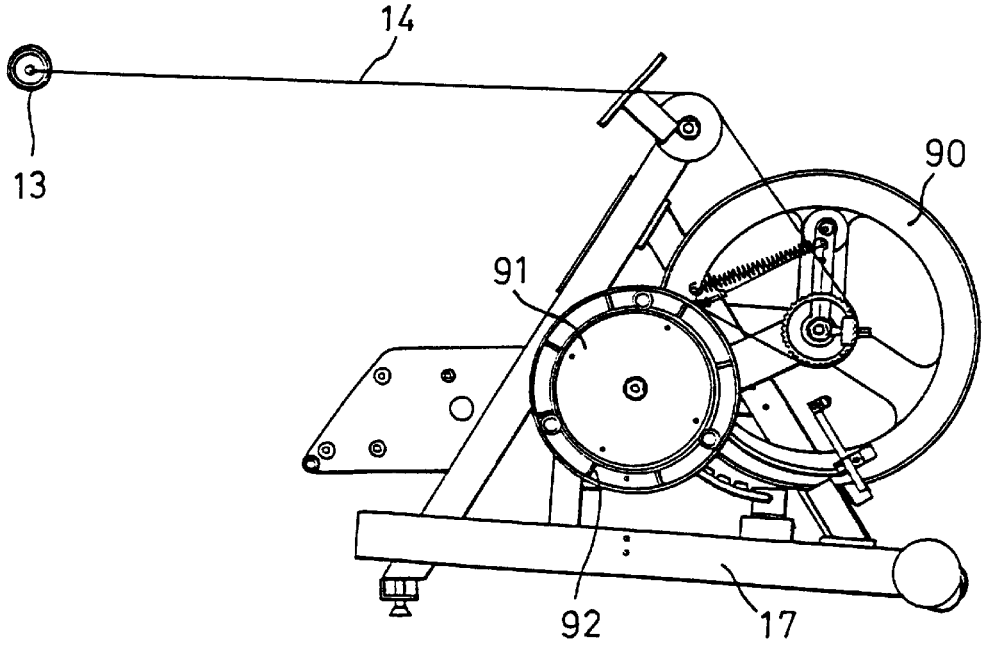
FIG. 5 PRIOR ART
FIG. 5 is a plan view similar to FIGS. 1, 3 and 4, illustrating a typical pulling type exerciser.
Figure 6:
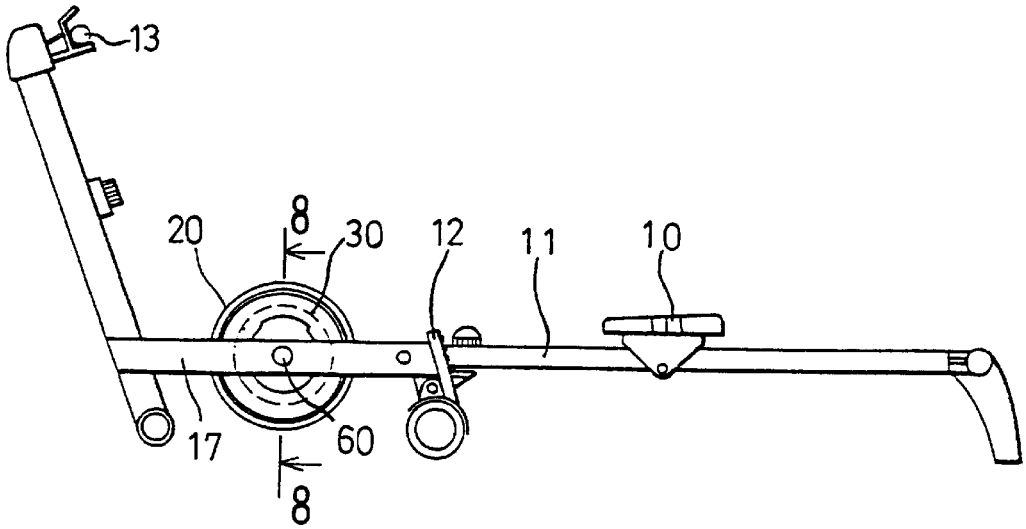
FIG. 6 is a plan view illustrating an exerciser in accordance with the present invention.

Referring to the drawings, and initially to FIG. 6, an exerciser in accordance with the present invention comprises a seat 10 slidably engaged and supported on a track 11 or the like, and a pair of foot pedals 12 provided for being stepped by the users. A paddle wheel, or a weight or another similar weight wheel 20 and a housing 30 are rotatably engaged on a base 17 with a pivot shaft 60. The above described structure of the exerciser is similar to the typical exercisers as shown in FIGS. 1–5 and thus will not be described in further details.

Figure 7:
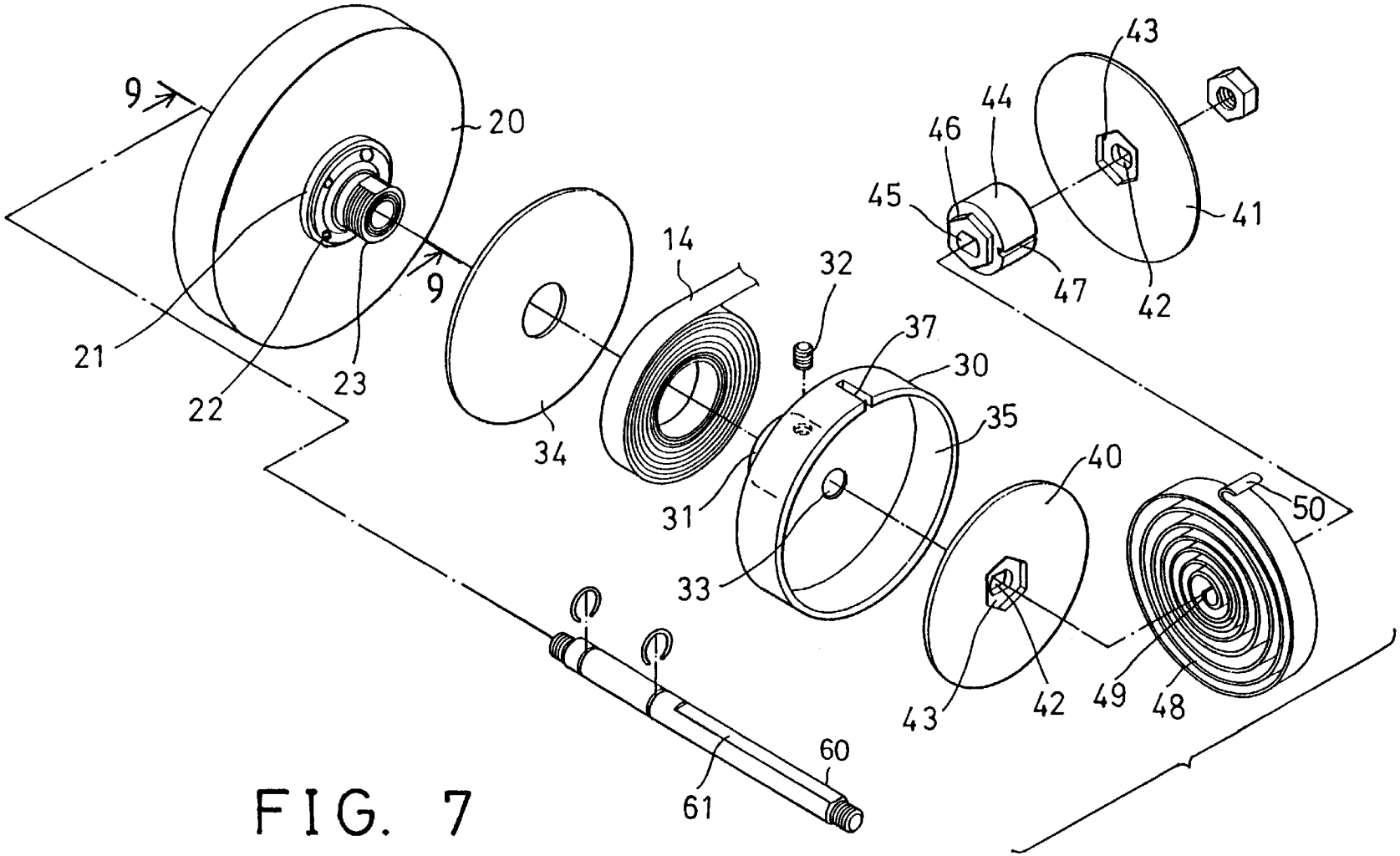
FIG. 7 is a partial exploded view illustrating the resistive device for the exerciser.
Figure 8:
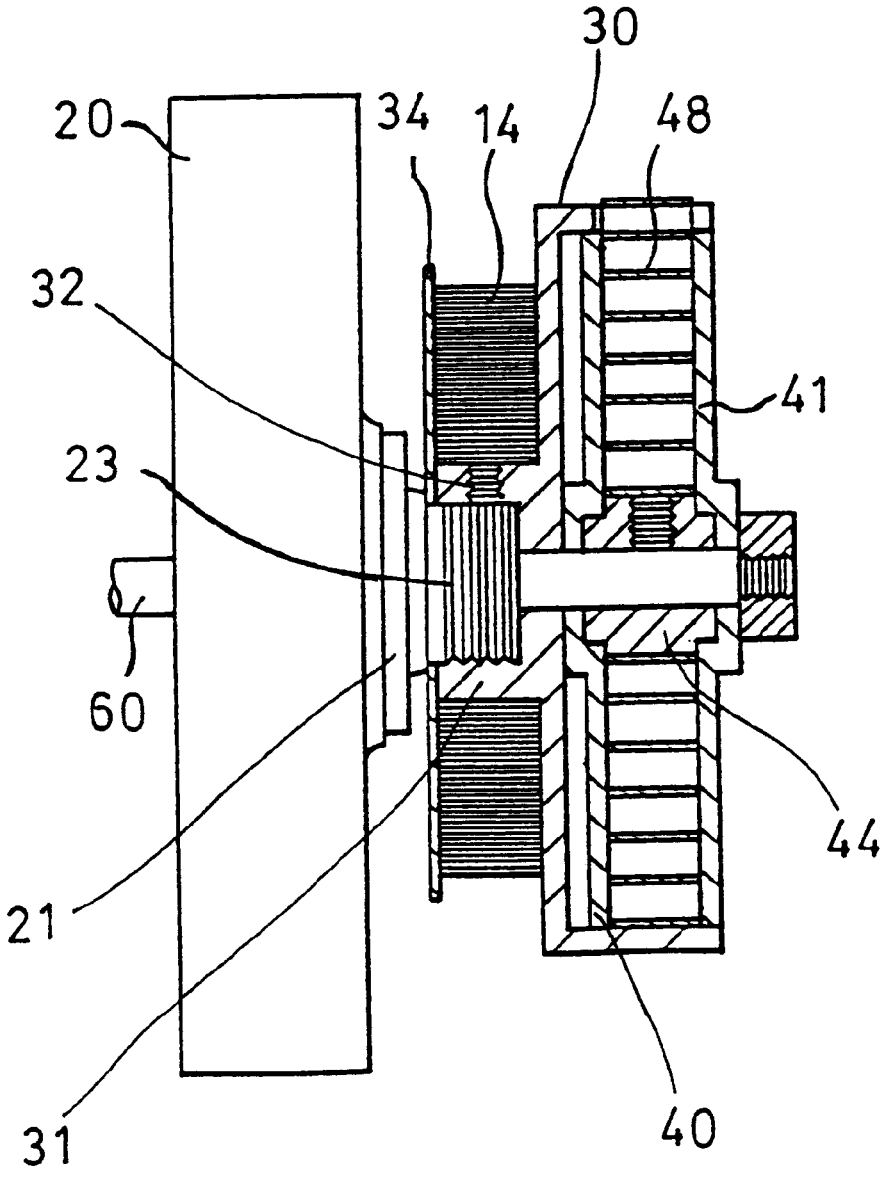
FIG. 8 is a partial cross sectional view taken along lines 8—8 of FIG. 6.
Figure 9:
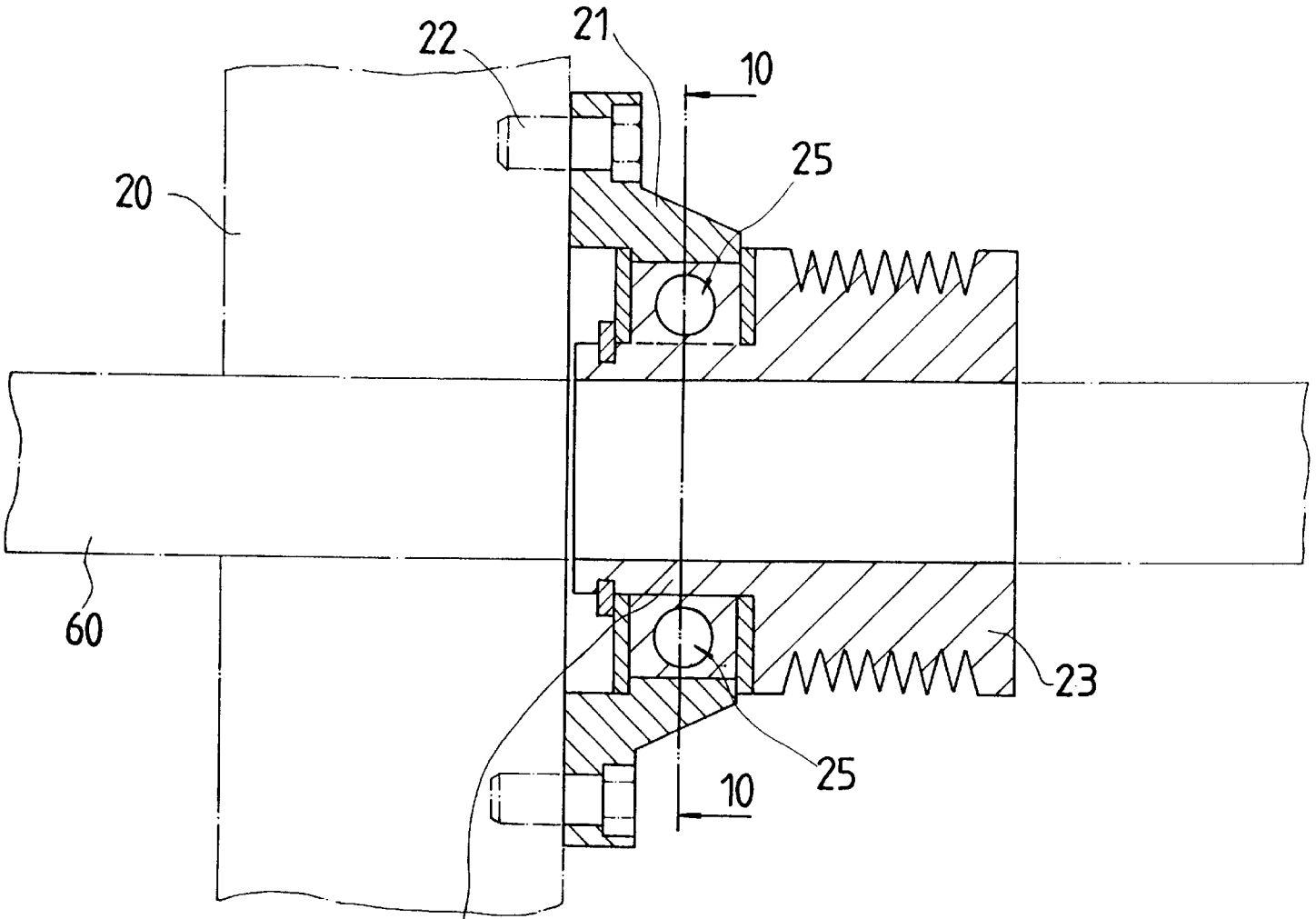
FIG. 9 is a partial cross sectional view taken along lines 9—9 of FIG. 7.
Figure 10:
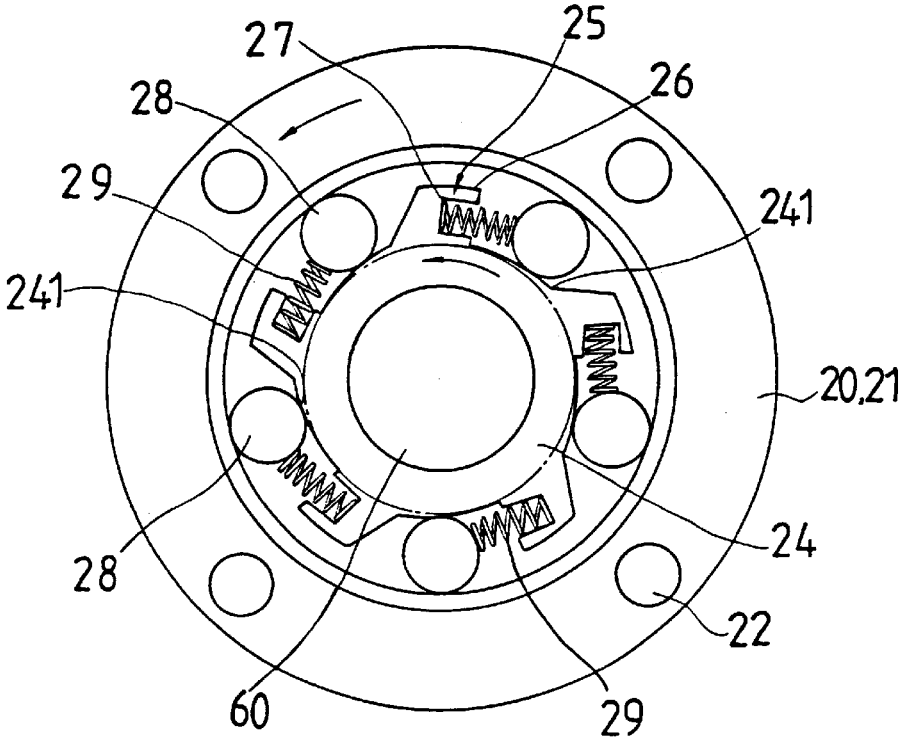
FIG. 10 is a cross sectional view taken along lines 10—10 of FIG. 9.

Referring next to FIGS. 7–9, the wheel 20 includes a bracket 21 extended therefrom or secured thereto with fasteners 22, and rotatably engaged on the shaft 60, i.e., the bracket 21 may be formed as an integral one-piece with the wheel 20 or may be secured to the wheel 20 with the fasteners 22. A conduit 23 is rotatably engaged on the shaft 60 and includes a bucket 24 extended therefrom and rotatably engaged in the bracket 21 of the wheel 20. As best shown in FIGS. 9–10, a unidirectional bearing 25 is provided between the wheel 20 and the conduit 23 for allowing the wheel 20 to be rotated in one direction relative to the conduit 23 only, and for preventing the wheel 20 from rotating relative to the conduit 23 in the other direction.

The bucket 24 includes one or more inclined surfaces or ramps 241 formed on the outer peripheral portion thereof, and one or more sockets 26 formed or provided on the outer peripheral portion thereof. The unidirectional bearing 25 includes one or more rollers or balls 28 provided between the bucket 24 and the bracket 21 of the wheel 20. One or more springs 29 have one end engaged in the cavities 27 of the sockets 26 respectively and the other end engaged with the balls 28 for biasing the balls 28 to engage with the ramps 241 of the bucket 24.

Figure 11:
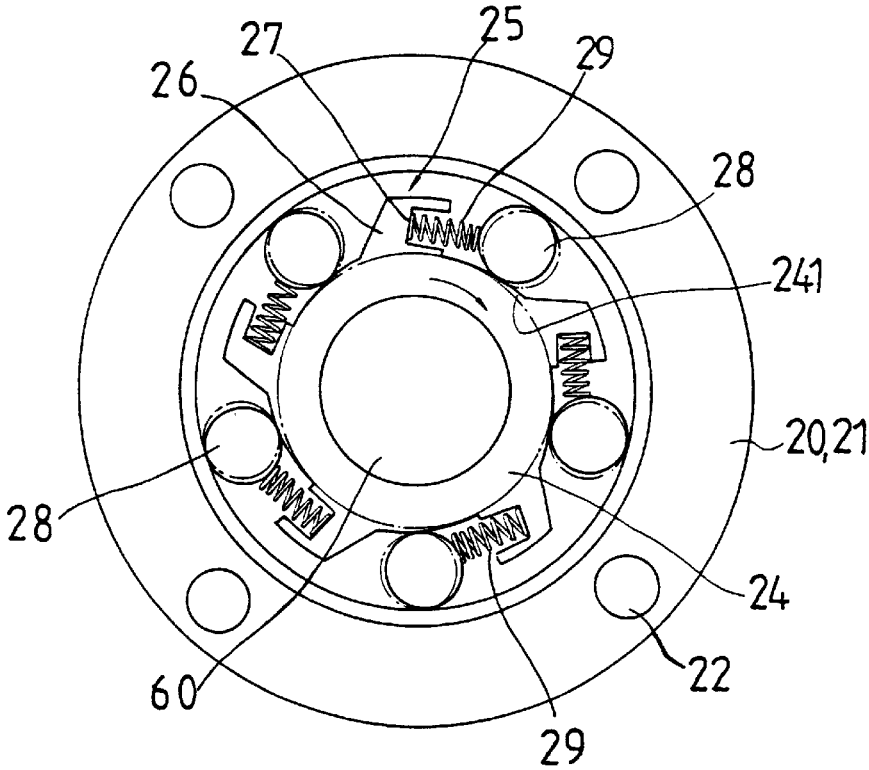
FIG. 11 is a cross sectional view similar to FIG. 10, illustrating the operation of the unidirectional bearing for the exerciser.

As shown in FIG. 10, when the bucket 24 and the conduit 23 are rotated counterclockwise, the balls 28 may be forced to be engaged between the bracket 21 and the ramps 241 of the bucket 24, such that the bracket 21 and the wheel 20 may also be rotated or driven counterclockwise by the bucket 24 and the conduit 23. On the contrary, as shown in FIG. 11, when the bucket 24 is rotated clockwise, the balls 28 may be moved away from ramps 241 of the bucket 24 against the springs 29, such that the bracket 21 and the wheel 20 may not be rotated or driven clockwise by the bucket 24 and the conduit 23.

As shown in FIGS. 7 and 8, the housing 30 includes a duct 31 engaged onto the conduit 23 and secured to the conduit 23 with one or more fasteners 32, such that the housing 30 and the conduit 23 are rotated in concert with each other relative to the shaft 60. The shaft 60 includes one or more flat surfaces 61 formed in some portions thereof, such that the shaft 60 includes a non-circular cross section in the portions thereof. The shaft 60 may be solidly secured to the base 17 with fasteners or the like. The housing 30 includes an orifice 33 formed therein for rotatably receiving the shaft 60 and for allowing the housing 30 to be rotated relative to the shaft 60.

A thread or cable or strap 14 is wound around the duct 31 and has one end secured to the duct 31, and may be pulled to actuate and rotate the housing 30. A panel 34 may be engaged on the conduit 23 and secured between the conduit 23 and the bracket 21 of the wheel 20, and may be engaged with the strap 14 for stably retaining the strap 14 on or around the duct 31, and for preventing the strap 14 from being disengaged from the duct 31. One or more handles 13 may be coupled to the other end of the strap 14 for pulling the strap 14 to actuate and rotate the housing 30. The housing 30 includes a chamber 35 formed therein for receiving a spring member 48 therein.

Two plates 40, 41 and a spacer 44 are received in the chamber 35 of the housing 30 and each includes an orifice 42, 45 formed therein and having a non-circular cross section for receiving the non-circular cross section portions of the shaft 60 and for allowing the plates 40, 41 and the spacer 44 to be secured to the shaft 60 and to be prevented from rotating relative to the shaft 60. The plates 40, 41 each further includes a non-circular recess 43 formed therein. The spacer 44 includes two extensions 46 formed or provided in the sides thereof and having a non-circular cross section for engaging into the non-circular recesses 43 of the plates 40, 41 and for further solidly securing the spacer 44 between the plates 40, 41. The spring member 48 is engaged on the spacer 44 and engaged between the plates 40, 41, and includes one end 49 engaged or hooked or secured to the slot 47 of the spacer 44, and the other end 50 engaged through or hooked or secured to the groove 37 of the housing 30. The spacer 44 and/or the plates 40, 41 may also be keyed and secured to the shaft 60.

In operation, as shown in FIG. 8, when the strap 14 is pulled by the handle 13, the housing 30 and thus the wheel 20 may be rotated or driven by the strap 14. The wheel 20 may be pulled and rotated in an active direction by the duct 31 of the housing 30 via the balls 28 of the unidirectional bearing 25 and the conduit 23. The housing 30 may thus be rotated relative to the plates 40, 41 against the spring member 48. When the handle 13 is released, the spring member 48 may recover the housing or may bias the housing 30 to rotate backward in order to coil or engage the strap 14 around the duct 31 again. The wheel 20 will not be rotated backward by the housing 30 due to the balls 28 of the unidirectional bearing 25, such that the spring member 48 will not be over rotated or over loaded or damaged by the wheel 20 when the wheel 20 is rotated backward. The working life of the spring member 48 may thus be increased.

Accordingly, the exerciser in accordance with the present invention includes an improved resistive device or mechanism for preventing the spring biasing member from being over-loaded and for increasing the working life of the spring biasing member.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A resistive device for an exerciser, said resistive device comprising:

a shaft, a wheel rotatably engaged on said shaft, a conduit rotatably engaged on said shaft, a housing rotatably engaged on said shaft, and secured to said conduit and rotated in concert with said conduit, a unidirectional bearing provided between said wheel and said conduit, for allowing said conduit and thus said wheel to be rotated in an active direction by said housing, and for preventing said wheel from being rotated in a reverse direction by said housing, means for rotating said housing relative to said shaft to rotate said wheel in the active direction, and means for biasing said housing to rotate in the reverse direction relative to said shaft, said wheel being prevented from rotated in the reverse direction by said housing.

2. The resistive device according to claim 1, wherein said wheel includes a bracket provided thereon, said conduit includes a bucket extended therefrom and engaged in said bracket of said wheel, said unidirectional bearing is engaged between said bracket of said wheel and said bucket of said conduit.

3. The resistive device according to claim 1, wherein said housing includes a duct extended therefrom and engaged on and secured to said conduit.

4. The resistive device according to claim 3, wherein said rotating means includes a strap engaged on said duct of said housing, said strap includes a first end secured to said duct and a second end for being pulled to rotate said housing relative to said shaft.

5. The resistive device according to claim 4 further comprising a panel engaged with said strap for retaining said strap between said panel and said housing.

6. The resistive device according to claim 1, wherein said biasing means includes a spring member provided between said shaft and said housing for biasing said housing to rotate in the reverse direction relative to said shaft.

7. The resistive device according to claim 6, wherein said housing includes a chamber formed therein for receiving said spring member, said spring member includes a first end secured to said housing.

8. The resistive device according to claim 7, wherein said housing includes a groove formed therein, said first end of said spring member is hooked to said groove of said housing.

9. The resistive device according to claim 7 further comprising a spacer secured on said shaft, said spring member including a second end secured to said spacer.

10. The resistive device according to claim 9, wherein said spacer includes a slot formed therein, said second of said spring member is hooked to said slot of said spacer.

11. The resistive device according to claim 9 further comprising two plates secured on said shaft and engaged with said spacer, said spring member being engaged on said spacer.

12. The resistive device according to claim 11, wherein said spacer includes two ends secured to said plates respectively.

13. The resistive device according to claim 12, wherein said plates each includes a non-circular recess formed therein, said ends of said spacer each includes a non-circular cross section and engaged in said non-circular recesses of said plates respectively for securing said spacer between said plates.

* * * * *